United States Patent [19]

Rankin

[11] 4,162,780

[45] Jul. 31, 1979

[54] ICE CUBE SERVICE

[75] Inventor: Armand T. Rankin, New Albany, Ind.

[73] Assignee: Stone City Products, Inc., Bedford, Ind.

[21] Appl. No.: 798,845

[22] Filed: May 20, 1977

[51] Int. Cl.[2] ..... F25C 1/24

[52] U.S. Cl. ..... 249/127; 249/126

[58] Field of Search ..... 249/118, 119, 120, 121, 249/126, 127, 70, 76, 136; 62/344, 320; 220/344, 341, 338, 337; D15/90

[56] References Cited

U.S. PATENT DOCUMENTS

| | | | |
|---|---|---|---|
| 2,587,852 | 3/1952 | Jahn et al. | 249/127 X |
| 2,704,927 | 3/1955 | Carrell | 249/119 X |
| 2,752,762 | 7/1956 | Gaugler | 249/127 |
| 2,961,850 | 11/1960 | Tupper | 249/126 |
| 3,021,695 | 2/1962 | Voightmann | 249/127 |
| 3,023,923 | 3/1962 | Geib et al. | 220/338 |
| 3,159,985 | 12/1964 | Keighley | 249/127 X |
| 3,477,095 | 11/1969 | Lensky | 249/121 X |
| 3,653,224 | 4/1972 | Tsen | 249/127 X |
| 3,968,921 | 7/1976 | Jewell | 220/337 X |
| 4,029,234 | 6/1977 | Johnson | 220/338 X |

FOREIGN PATENT DOCUMENTS

| | | | |
|---|---|---|---|
| 1923033 | 11/1969 | Fed. Rep. of Germany | 62/344 |

*Primary Examiner*—Richard B. Lazarus
*Assistant Examiner*—John S. Brown
*Attorney, Agent, or Firm*—Donald L. Cox

[57] ABSTRACT

An ice cube storage bin, including a container having opposing walls with side edges in the same plane, an ejector bar for ejecting ice from an ice tray, and a top rotably attached to the side walls to allow at least 90° rotation from fully closed to fully open is disclosed. This bin allows improved utilization of the space within a refrigerator freezer compartment and is utilized in conjunction with an ice cube tray having two longitudinally extended rows of less than half-spherical compartments attached to and penetrating through a tray bed.

3 Claims, 3 Drawing Figures

ICE CUBE SERVICE

BACKGROUND OF INVENTION

This invention relates to ice cube storage bins, and more particularly to ice cube storage bins adapted for the convenient storage and dispensing of ice cubes in a refrigerator freezer compartment.

Ice cube storage containers or bins have been previously provided, but most have been inconvenient to employ in the freezer compartments of refrigerators because of the excessive space which they require. In particular, these storage bins have been designed in such a way that frozen food cannot be stored readily on top of the bins, while still providing a method for removal of ice without the simultaneous removal of the ice tray itself. The requirement that prior art storage bins be removed from the freezer compartment for filling with or removal of ice, has caused the ice cubes to melt and then refreeze, resulting in a conglomeration of the ice cubes within the storage compartment.

Thus, it is an object of this invention to provide an ice cube storage bin which provides ready access to stored ice cubes and at the same time allows the storage of frozen foods and other materials on top of the tray.

It is another object of this invention to provide an ice cube storage bin having a top which may be readily opened and closed to allow the introduction of fresh ice cubes.

It is a further object of this invention to provide an ice cube storage bin which may be filled and used without removal from the refrigerator freezer compartment, thus reducing the tendency of the ice cubes in the compartment to conglomerate.

Ice cube containers for refrigerator storage of various types have been disclosed. In U.S. Pat. No. 3,653,224, an ice maker is disclosed having a flexible tray top. However, the top disclosed therein is susceptible to falling off the top of the ice tray and does not rotate to allow access to the inner portions of the tray.

In U.S. Pat. No. 3,803,868, an ice cube tray is disclosed having a permanent top, into which may be inserted ice cube trays. However, the top disclosed therein is not rotable for easy access.

SUMMARY OF INVENTION

The ice cube bin of the instant invention includes a storage container having opposing walls, with side edges in the same plane, an ejector bar for ejecting ice from an ice tray, and a top rotably attached to the side walls to allow at least 90° rotation from fully closed to fully open. Used in combination with the storage container herein is an ice cube tray comprising two longitudinally extended rows of less than half-spherical compartments attached to and penetrating through the tray bed. Other objects, features and advantages of the instant invention are obtained by the following detailed description.

DETAILED DESCRIPTION OF DRAWINGS

DESCRIPTION OF THE PREFERRED EMBODIMENTS

Figure 1:
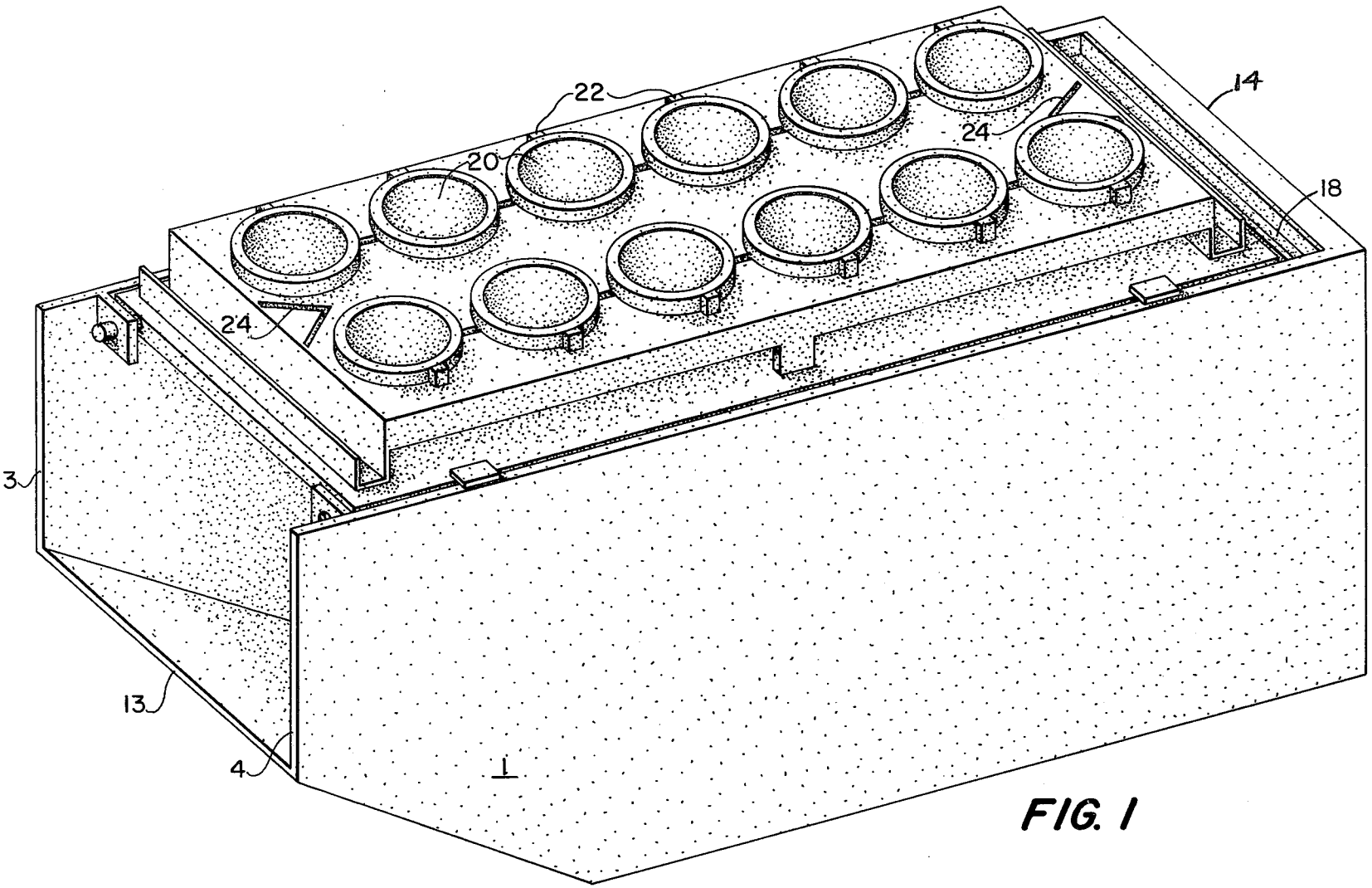
FIG. 1 is a prospective view of the instant invention.
Figure 2:
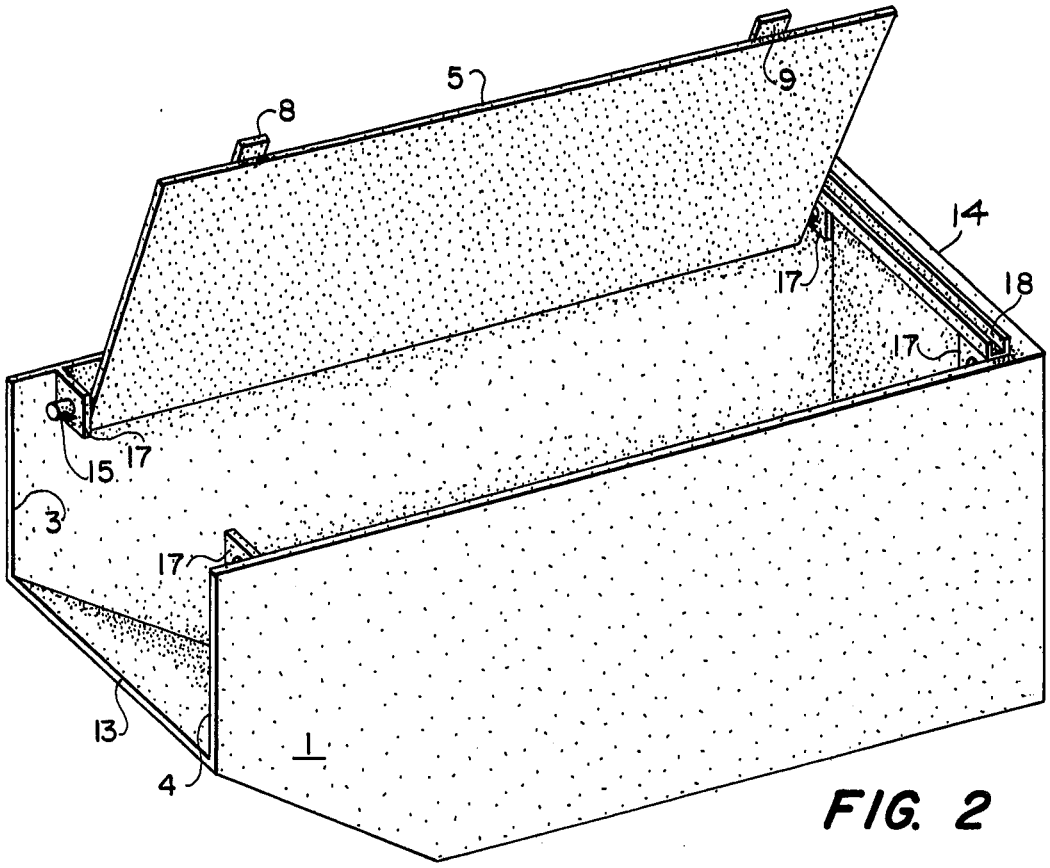
FIG. 2 is a front view of the instant invention with the top in the open position.
Figure 3:
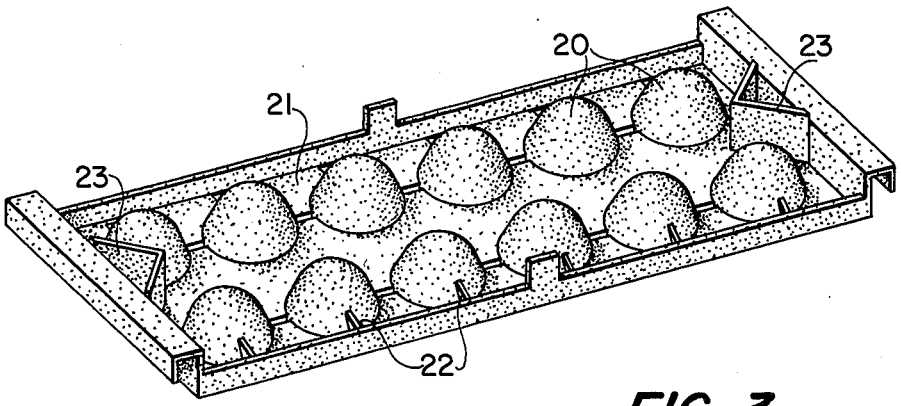
FIG. 3 is a bottom view of the ice cube storage tray.

The ice service of the instant invention comprises an ice storage receptacle (1) to which has been rotably attached a top (5). In the preferred embodiment, the receptacle is provided with a horizontal rectangular slot adapted to receive the edge of an ice cube tray to facilitate removal of the ice.

The receptacle (1) of rectangular cross-section comprises opposing walls (3 & 4), a rear wall (14), and a relatively short front wall (13), providing access at the front of the receptacle through which ice cubes may be removed without removing the top (5) or articles stored above the top when the receptacle is in the refrigerator.

The top itself may be rotably attached to either of the side walls to provide about 45° to about 120° of rotation from a "fully closed" position when the top is in position covering the upper portions of the ice service, to a "fully open" position when the top is in a roughly vertical plane with respect to the base of the ice service. Thus, the top in a preferred embodiment may be equipped with ear means (15) for insertion into ear means receptacles (17) which are attached to the sides (3 & 4). By this construction, it is possible to provide either lefthanded or righthanded opening tops, depending upon the type of refrigerator utilized. In addition, the top should preferably be equipped with closing stops (8 & 9). These stops preferably protrude on the side edge away from the side to which the ears are attached, and extend slightly above the plane of the top, so that when the top is in place, it actually extends below the plane formed by the top of the sides to provide complete closure.

The rear wall is in the preferable instance equipped with the horizontal rectangular slot (18) adapted to receive the handle which is normally provided on ice cube trays. The handle of the tray is inserted into the horizontal rectangular slot and pressure is then applied to the front of the tray causing ice to be forced out of the tray itself.

The ice cube tray utilized in the instant invention is of rectangular construction, preferably formed of a flexible plastic material, and is comprised generally of two longitudinally extended rows of less than half-spherical ice cube compartments (20). The term "less than half-spherical" refers to those compartments in which a vertical tangent along the upper open edge of the sphere will be less than about 90° to the horizontal. Included in the term "less than half-spherical" are compartments which are formed with both parabolic and hyperbolic cross-sections. The key element to these compartments is that the sides of the compartments continue to slope in a slightly outward fashion to allow easy removal of ice cubes. These compartments, of course, should be flexible in nature to also insure that cubes prepared in them are easily removed. The walls of the compartments are preferably horizontally ribbed to provide wall sections of varying thickness. This design allows for easier removal of the ice cubes from the tray when the walls are distorted by bending of the tray bed. The compartments are attached to a tray bed (21) projecting through the bed with a portion of the compartment extending above the bed and a portion below to the bottom side of the bed. Each compartment is provided with a compartment distortion means (22) which is preferably a triangular piece of plastic attached to the tray bed and the ice compartment so that twisting of the bed will cause a distortion in the walls of the ice cube compartments and ejection of the ice cubes from the compartments. In the most preferred instance, the distortion means likewise penetrates the tray bed so that movement of the bed by twisting it will cause a distortion of the compartment walls above and below the bed. The bottom of the tray is provided with stacking supports (23) of convenient shapes, with the top of the tray provided with stacking support receivers (24), so that stacking of several trays may be accomplished and movement of the trays retarded. As can be seen from the drawings appended hereto, no side baffles are provided to the sides of the ice cube compartments from sideways exposure. In most prior art ice cube trays, this side baffling shields the ice cube compartments from immediate exposure to the cold of the refrigerator freezer compartment, thus increasing the amount of time it takes for freezing to occur. Finally, each end of the tray is equipped with a handle for insertion into the horizontal rectangular slot on the rear wall of the ice cube service. This slot acts to facilitate ice cube removal.

While there has been shown and described specific embodiments of the present invention. It is to be understood that this invention is not limited by these embodiments, and it is intended that the appended claims cover all modifications falling within the scope and spirit of this invention.

What is claimed is:

1. An ice cube tray comprising two longitudinally extended rows of less than half spherical flexible compartments attached to and penetrating through a flexible tray bed, wherein distortion means are provided on the top and on the bottom of the tray bed, said distortion means being attached in both places to sides of the compartment and the tray bed.

2. The tray of claim 1 having on the bottom side stacking support means and on the top side stacking support receivers, so that a number of trays may be stacked together.

3. The tray of claim 1 wherein the walls of the compartments are of variable thickness.

* * * * *